US011827319B1

(12) United States Patent
Perdomo Tornbaum

(10) Patent No.: US 11,827,319 B1
(45) Date of Patent: Nov. 28, 2023

(54) METHODS FOR A MARINE VESSEL WITH PRIMARY AND AUXILIARY PROPULSION DEVICES

(71) Applicant: Brunswick Corporation, Mettawa, IL (US)

(72) Inventor: Andres Perdomo Tornbaum, Neenah, WI (US)

(73) Assignee: Brunswick Corporation, Mettawa, IL (US)

( * ) Notice: Subject to any disclaimer, the term of this patent is extended or adjusted under 35 U.S.C. 154(b) by 402 days.

(21) Appl. No.: 16/984,617

(22) Filed: Aug. 4, 2020

(51) Int. Cl.
*B63B 79/40* (2020.01)
*B63H 25/02* (2006.01)

(52) U.S. Cl.
CPC ..... *B63B 79/40* (2020.01); *B63H 25/02* (2013.01); *B63H 2025/026* (2013.01)

(58) Field of Classification Search
CPC .... B63B 79/40; B63H 25/02; B63H 2025/026
See application file for complete search history.

(56) References Cited

U.S. PATENT DOCUMENTS 4,294,186 A 10/1981 Wardell
5,131,875 A 7/1992 Lee
5,152,240 A 10/1992 Fontanille
6,142,841 A 11/2000 Alexander, Jr. et al.
6,280,267 B1 8/2001 Griffith, Sr. et al.
6,592,412 B1 7/2003 Geil et al.
7,004,803 B2 2/2006 Ruffe
7,150,662 B1 12/2006 Janitz
7,188,581 B1 3/2007 Davis et al.
7,381,108 B1 6/2008 Salmon
7,565,876 B2 7/2009 Wilson et al.
7,765,946 B1 8/2010 Berman et al.
8,818,587 B1 * 8/2014 Arbuckle ..... B63H 25/02 703/2
9,334,034 B1 5/2016 Waldvogel et al.
9,694,892 B1 7/2017 Anschuetz et al.
9,738,364 B2 8/2017 Abney
9,764,810 B1 9/2017 Andrasko et al.
(Continued)

OTHER PUBLICATIONS

Max Power, "Retractable Thrusters," web page, last visited Feb. 11, 2020, available at https://www.max-power.com/category/14-retractable-thrusters.

(Continued)

*Primary Examiner* — Hunter B Lonsberry
*Assistant Examiner* — Harrison Heflin
(74) *Attorney, Agent, or Firm* — Andrus Intellectual Property Law, LLP

(57) ABSTRACT

A method for a marine vessel includes determining if a first propulsion device on the marine vessel is rotated about a horizontal tilt/trim axis above a predetermined threshold and determining if a second propulsion device on the marine vessel is deployed. If the second propulsion device is deployed, the method includes retracting the second propulsion device in response to determining that the first propulsion device is rotated above the predetermined threshold. If the second propulsion device is not deployed, the method includes prohibiting the second propulsion device from being deployed in response to determining that the first propulsion device is rotated above the predetermined threshold.

20 Claims, 5 Drawing Sheets

(56) References Cited

U.S. PATENT DOCUMENTS

| | | | | |
|---|---|---|---|---|
| 9,862,471 | B1 | 1/2018 | Taylor et al. | |
| 9,937,984 | B2 | 4/2018 | Herrington et al. | |
| 10,011,339 | B2 | 7/2018 | Anschuetz | |
| 10,167,069 | B2 | 1/2019 | Houle et al. | |
| 10,281,928 | B2 | 5/2019 | Behling et al. | |
| 10,435,127 | B2 | 10/2019 | Suzuki et al. | |
| 11,572,146 | B2 | 2/2023 | Kraus et al. | |
| 2008/0173227 | A1* | 7/2008 | Salmon | B63B 39/061 114/285 |
| 2010/0136857 | A1 | 6/2010 | Goudsmit | |
| 2014/0329422 | A1* | 11/2014 | Ito | B63H 5/08 440/1 |
| 2018/0335788 | A1* | 11/2018 | Behling | B63H 20/10 |
| 2019/0344869 | A1* | 11/2019 | Chan | B63H 20/12 |
| 2021/0237834 | A1* | 8/2021 | They | B64C 35/008 |
| 2022/0266972 | A1 | 8/2022 | Novak et al. | |

OTHER PUBLICATIONS

Lewmar, "Swing Thruster," Product and Installation Manual, 2013, Issue 1.

Sideshift, "Houseboat Thrusters," web page, last visited Feb. 11, 2020, available at https://sideshift.com/products/houseboat-thrusters/.

Dockstar, "Smart Thruster," Operations Manual, 2018, available at https://ff73590a-69f6-41f4-aeea-2c36215fc9e4.filesusr.com/ugd/d51fcc_bc562379e09d4841ae170997f737cd97.pdf.

Gable et al., "Marine Vessels Having a First Marine Drive and a Second Marine Drive and Methods for Controlling Them," U.S. Appl. No. 18/315,323, filed May 10, 2023 (drawings, specification, and claims only).

* cited by examiner

METHODS FOR A MARINE VESSEL WITH PRIMARY AND AUXILIARY PROPULSION DEVICES

FIELD

The present disclosure relates to marine vessels with primary and auxiliary propulsion devices, and more specifically to marine vessels with retractable auxiliary propulsion devices.

BACKGROUND

U.S. Pat. No. 6,142,841 discloses a maneuvering control system which utilizes pressurized liquid at three or more positions of a marine vessel in order to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired. Electrical embodiments of the present invention can utilize one or more pairs of impellers to cause fluid to flow through outlet conduits in order to provide thrust on the marine vessel. In one embodiment of the present invention, a cross thrust conduit is associated with a marine vessel to direct fluid flow in a direction perpendicular to a centerline of the marine vessel and a pair of outlet conduits are associated with the marine vessel to direct flows of fluid in directions which are neither parallel nor perpendicular to a centerline of the marine vessel. In this embodiment, reversible motors are used to rotate associated impellers in either forward or reverse directions. In any of the embodiments of the present invention, a joy stick control can be used to select or deselect each of the outlet conduits and, in certain embodiments, to select the direction of operation of an associated reversible motor.

U.S. Pat. No. 7,150,662 discloses an improved docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,765,946 discloses a system and apparatus for providing integrated boat thrusters which eliminates interfering with the integrity of the hull, and undesirable drilling and cutting of the hull to accommodate separate glass tubes or pipes that are conventionally used to form thruster tunnels. The instant system provides integrally molded thruster tunnel sections within the hull, and unique keystone inserts which are complementary to the molded thruster tunnel sections and complete the water flow chambers through the hull about the propellers. Separate tubes are not utilized. Thruster motors and mounting mechanisms are securely fastened in flat planes enhancing strength, performance and maintenance of the assemblies. In a preferred embodiment, the keystone insert is generally wedge shaped to provide a secure fit and bond within the molded tunnel section having angled walls.

The above patents are incorporated herein by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to a first example, a method for a marine vessel, which is carried out by a vessel control system, includes determining if a first propulsion device on the marine vessel is rotated about a horizontal tilt/trim axis above a predetermined threshold and determining if a second propulsion device on the marine vessel is deployed. If the second propulsion device is deployed, the method includes retracting the second propulsion device in response to determining that the first propulsion device is rotated above the predetermined threshold. If the second propulsion device is not deployed, the method includes prohibiting the second propulsion device from being deployed in response to determining that the first propulsion device is rotated above the predetermined threshold.

According to another example, a method for a marine vessel, which is carried out by a vessel control system, includes retracting or maintaining a retracted position of an auxiliary propulsion device on the marine vessel in response to a primary propulsion device on the marine vessel being rotated about a horizontal tilt/trim axis above a predetermined threshold and the auxiliary propulsion device being deployed or commanded to deploy, respectively.

According to another example, a method for a marine vessel, which is carried out by a vessel control system, includes determining if a primary propulsion device on the marine vessel is rotated about a horizontal tilt/trim axis above a predetermined threshold and determining if an auxiliary propulsion device on the marine vessel is deployed. In response to determining that the auxiliary propulsion device is deployed and the primary propulsion device is rotated above the predetermined threshold, the method includes doing at least one of the following: retracting the auxiliary propulsion device and/or emitting an alert. In response to determining that the auxiliary propulsion device is not deployed and the primary propulsion device is rotated above the predetermined threshold, the method includes doing at least one of the following: overriding a command to deploy the auxiliary propulsion device and/or emitting the alert.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
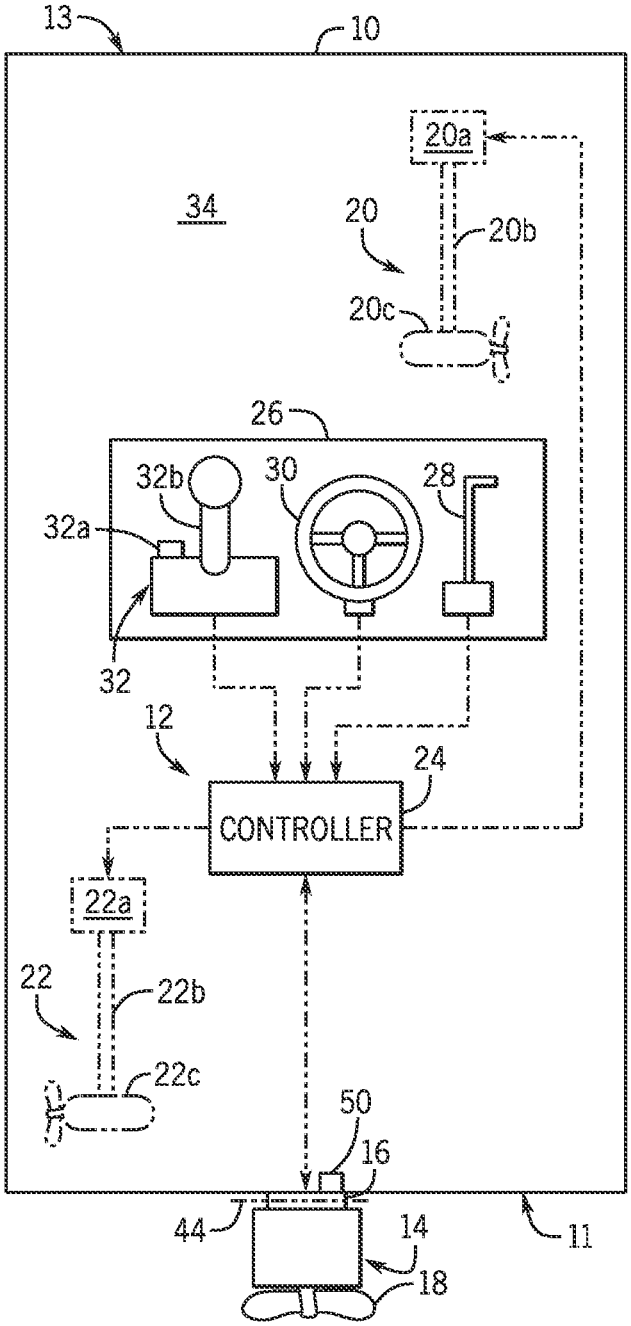
FIG. 1 is a schematic view of a marine vessel having a primary propulsion device, two auxiliary propulsion devices, and a vessel control system in communication therewith.

FIG. 1 illustrates a marine vessel 10 including a vessel control system 12. An engine-powered primary propulsion device 14 is coupled to a stern 11 of the marine vessel 10 by way of a mounting bracket 16, which includes a tilt/trim mechanism for rotating the primary propulsion device 14 about a horizontal tilt/trim axis 44, as is known. In the example shown herein, the primary propulsion device 14 is an outboard engine having a propeller 18 that rotates to produce thrust to propel the marine vessel 10 through water; however, the primary propulsion device 14 could instead be a stern drive, an outboard jet drive, or any other tilt/trimmable marine propulsion device, whether steerable or non-steerable. Additionally, as is known, more than one engine-powered primary propulsion device could be provided on the marine vessel 10.

The marine vessel 10 also includes two auxiliary (usually non-engine-powered) propulsion devices 20, 22 near the bow 13 and stern 11 of the marine vessel 10, respectively. In the present example, each auxiliary propulsion device 20, 22 is a retractable thruster and is shown in phantom because it is coupled to an underside of the marine vessel 10 as will be described further herein below. Each auxiliary propulsion device 20, 22 includes an actuator 20*a*, 22*a*, coupled to a shaft 20*b*, 22*b*, which is in turn coupled to a thrust unit 20*c*, 22*c* including a propeller. A motor is provided inside each thrust unit 20*c*, 22*c* to power the propeller thereof. In other examples, an auxiliary propulsion device is provided only at the bow 13 or only at the stern 11 of the marine vessel 10. In still other examples, multiple auxiliary propulsion devices are provided at the bow 13 and/or stern 11, and/or thrusters are provided elsewhere on the marine vessel 10.

The exact configuration of the retractable auxiliary propulsion devices 20, 22 is not limiting on the scope of the present disclosure. As is known to those having ordinary skill in the art, bow and stern thrusters can be externally mounted and movable away from and back towards the hull of the marine vessel 10, or internally mounted and extendable out of and retractable into the hull. The auxiliary propulsion devices 20, 22 can be steerable so as to vary a direction of thrust of the respective thrust units 20*c*, 22*c*, or can be rotationally fixed in place. The auxiliary propulsion devices 20, 22 can be conventional propeller or impeller thrusters, water jet thrusters, or trolling-motor-like thrusters as shown and described herein. In some examples, the auxiliary propulsion devices 20, 22 can produce thrust in two different directions, such as by varying the direction of rotation of their propellers or impellers or the direction of water discharged through their nozzles. The auxiliary propulsion devices 20, 22 can each be powered by an electric source such as a battery or a solar panel connected to an electric motor or to a hydraulic pump-motor system. For example, if each auxiliary propulsion device's power source is an electric motor, each auxiliary propulsion device 20, 22 may include an output shaft, gear set, transmission, or motor armature inside a housing with magnets that rotates a propeller or impeller shaft or the pump shaft of a water pump. The above-described types of thrusters are well known in the art and therefore will not be described further herein.

Still referring to FIG. 1, the vessel control system 12 includes a controller 24 in signal communication with the primary propulsion device 14 and the auxiliary propulsion devices 20, 22. The controller 24 is programmable and includes a processor and a memory. The controller 24 can be located anywhere on the marine vessel 10 and can communicate with various components of the marine vessel 10 via a peripheral interface and wired and/or wireless links, as will be explained further herein below. Although FIG. 1 shows one controller 24, the vessel control system 12 can include more than one controller. Portions of the methods disclosed herein below can be carried out by a single controller or by several separate controllers. For example, the vessel control system 12 can have controllers located at or near a control console 26 of the marine vessel 10 and can also have controllers located at or near the primary propulsion device 14 and/or the auxiliary propulsion devices 20, 22. If more than one controller is provided, each can control operation of a specific device or sub-system on the marine vessel 10.

In some examples, the controller 24 may include a computing system that includes a processing system, storage system, software, and input/output interfaces for communicating with peripheral devices. The systems may be implemented in hardware and/or software that carries out a programmed set of instructions. For example, the processing system loads and executes software from the storage system, which software directs the processing system to operate as described herein below in further detail. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The controller 24 communicates with one or more components on the marine vessel 10 via the I/O interfaces and a communication link, which can be a wired or wireless link. The controller 24 is capable of monitoring and controlling one or more operational characteristics of the various systems and subsystems onboard the marine vessel 10 by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the controller 24 and each of the peripheral devices in the vessel control system 12 noted herein, although not every connection is shown in the drawing for purposes of clarity.

The control console 26 includes a number of user-operated input devices in signal communication with the controller 24. For instance, the control console 26 includes a shift/throttle lever 28 for inputting gear and speed commands to the controller 24, which then commands the primary propulsion device 14 to shift to forward, neutral, or reverse and to position the throttle of the engine accordingly, as is known. A steering wheel 30 is provided for inputting directional steering commands to the controller 24, which the controller 24 outputs to a steering actuator that controls a steered position of the primary propulsion device 14. The control console 26 also includes a joystick 32 that is tiltable and rotatable to provide vessel movement commands to the controller 24. In order to enable a joysticking mode of the vessel control system 12, it may be required that an operator first manipulate a user input device, such as a button 32*a* located on the base of the joystick 32. Furthermore, in some examples, it may also be required that the engine of the primary propulsion device 14 is on and running and that the shift/throttle lever 28 is in neutral before the joysticking mode can be enabled via the button 32*a*. Note that there are other ways to enable the joysticking mode, however, and the above examples are not limiting on the scope of the present disclosure.

In a non-joysticking mode, an operator is able to maneuver the marine vessel 10 generally forwards or backwards by commanding the primary propulsion device 14 to forward or reverse gear using the shift/throttle lever 28. The operator may further maneuver the marine vessel 10 at an angle to one side or the other using the steering wheel 30 while traveling forwards or backwards under the power of the primary propulsion device 14. However, on vessels equipped with only one primary propulsion device 14, it is very difficult, if not impossible, to maneuver the marine vessel 10 directly side-to-side (lateral translation) or in a tight radius, which are maneuvers typically requested while operating in a joysticking mode. By providing auxiliary propulsion devices 20, 22, the marine vessel 10 is able to accomplish such "joysticking maneuvers," as more than one source of thrust at more than one location is provided to move the vessel 10. For example, in the joysticking mode, under the power of the auxiliary propulsion devices 20, 22, the handle 32*b* of the joystick 32 can be tilted away from its resting vertical orientation in order to request movement of the vessel 10 in any of a forward, reverse, starboard, port and/or combined (e.g., diagonal) direction. Additionally, the handle 32*b* or knob of the joystick 32 can be rotated about the handle axis in order to request rotation (yaw) of the vessel 10. As known to those having ordinary skill in the art, the handle 32*b* of the joystick 32 can be rotated at the same time that it is tilted in order to request both rotation and translation of the vessel 10 at the same time. The controller 24 interprets these inputs from the joystick 32 and outputs commands to the auxiliary propulsion devices 20, 22 to cause them to turn on or off, increase or decrease propeller speed, rotate about steering axes, and/or change directions (forward or reverse) accordingly so as to achieve the commanded maneuvers. The algorithms that the controller 24 can use to translate inputs from the joystick 32 to outputs to the auxiliary propulsion devices 20, 22 are well known in the art and therefore will not be discussed further herein.

Figure 2:
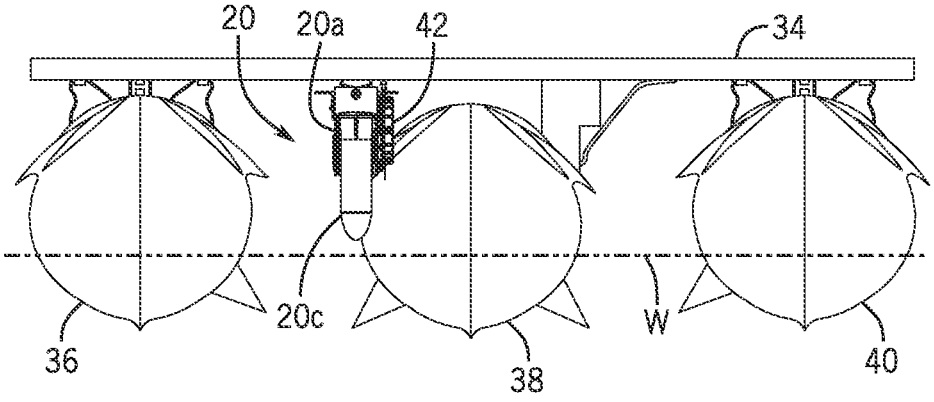
FIG. 2 is a front elevation view of a portion of a marine vessel, such as a pontoon boat, equipped with an auxiliary propulsion device in a retracted position.

FIG. 2 is a front elevation view of a portion of the marine vessel 10. In this example, the marine vessel 10 is a pontoon boat having a deck 34 with three pontoons 36, 38, 40 coupled to the underside thereof. While the auxiliary propulsion device 22 at the stern 11 of the marine vessel 10 cannot be seen, as it is located behind the pontoon 40, the auxiliary propulsion device 20 at the bow 13 of the marine vessel 10 is shown between the pontoons 36 and 38. Although the auxiliary propulsion device 22 will not be described further herein, it can be designed and operate in the same manner as the auxiliary propulsion device 20 described herein below. It can be seen that the auxiliary propulsion device 20 is coupled to the bottom surface of the deck 34 by way of a bracket 42, to which the actuator 20*a* is also attached. In FIG. 2, the auxiliary propulsion device 20 is shown in a retracted position, in which the shaft 20*b* (not shown, but see FIGS. 1, 3) is generally parallel to the deck 34, and the thrust unit 20*c* is stowed next to the bottom surface of the deck 34. In another example, the shaft 20*b* may be retracted to an acute angle with respect to the bottom surface of the deck 34. In still another example, the shaft 20*b* may be a telescoping shaft, which remains perpendicular to the bottom surface of the deck 34 when retracted. The bracket 42 and auxiliary propulsion device 20 can be designed such that in the retracted position, the thrust unit 20*c* (and indeed, the entire auxiliary propulsion device 20) is above the water level W.

Figure 3:
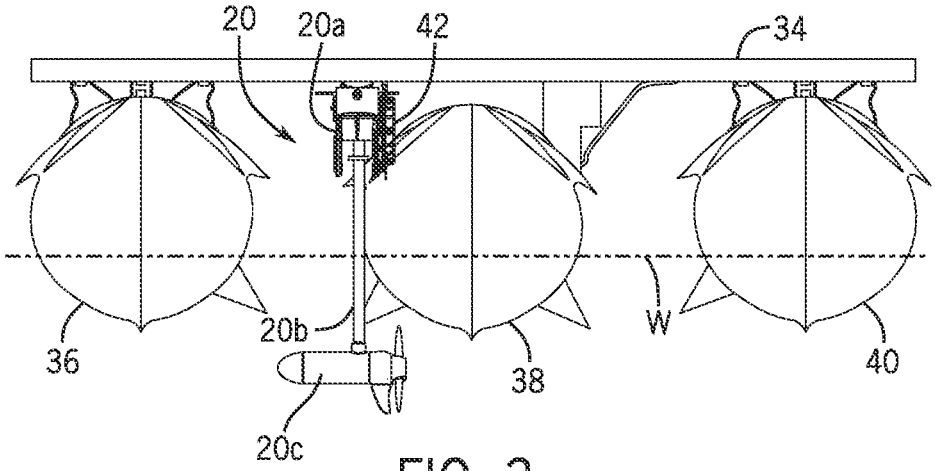
FIG. 3 is a front elevation view of the portion of the pontoon boat with the auxiliary propulsion device in a deployed position.

In contrast, in FIG. 3, the auxiliary propulsion device 20 is in a deployed position, in which the shaft 20*b* is generally perpendicular to the deck 34 and the thrust unit 20*c* is further from the deck 34 than when the auxiliary propulsion device 20 is in the retracted position. The bracket 42 and auxiliary propulsion device 20 can be designed such that in the deployed position, the thrust unit 20*c* is below the water level W, and thus able to produce thrust to maneuver the marine vessel 10 in the water. In the present example, in which the auxiliary propulsion device 20 is provided on a pontoon boat, the deployed depth of the thrust unit 20*c* below the deck 34 can be specifically designed to be below the bottom surfaces of the pontoons 36, 38, 40, so that the pontoons 36, 38, 40 do not interfere with the thrust generated by the thrust unit 20*c* and the propeller is not spinning in air.

In order to move the auxiliary propulsion device 20 from the retracted position of FIG. 2 to the deployed position of FIG. 3, the controller 24 activates the electric or hydraulic actuator 20*a* to lower the thrust unit 20*c* of the auxiliary propulsion device 20 by pivoting the shaft 20*b* about an axis along which the opposite end of the shaft 20*b* is coupled to the bracket 42. The actuator 20*a* could be a hydraulic piston/cylinder, an electric linear actuator, an electric rotary actuator, an electric motor coupled to a gear set or a rack-and-pinion device, or any other actuator suitable for use in a marine environment. Portions of the actuator 20*a* for retracting and deploying the auxiliary propulsion device 20 could be used to steer the thrust unit 20*c* in the event that the auxiliary propulsion device 20 is steerable, or a separate steering actuator could be provided.

Figure 4:
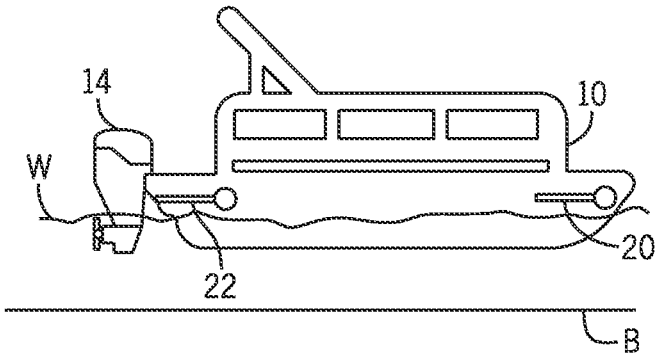
FIG. 4 is a schematic showing a marine vessel with a primary propulsion device and an auxiliary propulsion device operating in deep water with the auxiliary propulsion device retracted.
Figure 5:
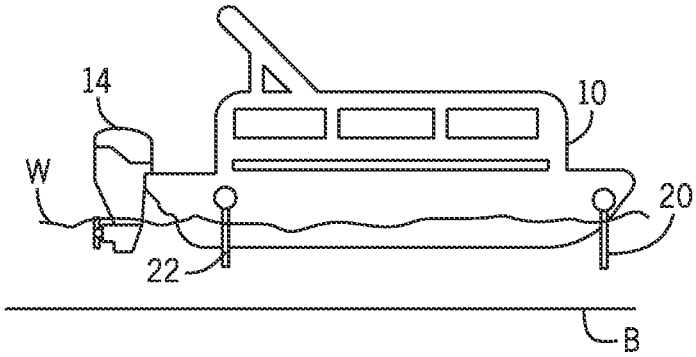
FIG. 5 is a schematic showing the marine vessel with the primary propulsion device and the auxiliary propulsion device operating in deep water with the auxiliary propulsion device deployed.
Figure 6:
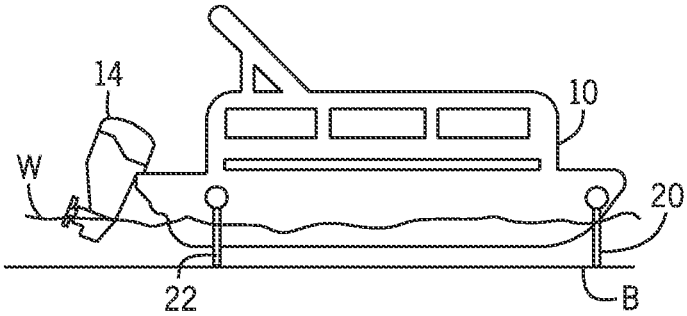
FIG. 6 is a schematic showing the marine vessel with the primary propulsion device and the auxiliary propulsion device operating in shallow water with the auxiliary propulsion device deployed.

Generally, a pontoon boat will benefit from provision of the retractable auxiliary propulsion devices 20, 22 because the pontoons 36, 38, 40 raise the deck 34 of the marine vessel 10 out of the water while providing room between the deck 34 and the water level W within which the retracted auxiliary propulsion devices 20, 22 can be stowed. As shown in FIG. 4, when the operator is using the primary propulsion device 14 to maneuver the marine vessel 10, the auxiliary propulsion devices 20, 22 remain out of the water and therefore do not create extra drag, nor are they able to be damaged by debris in the water. However, as shown in FIG. 5, when the operator wants to accomplish more precise maneuvers than those available with a single primary propulsion device 14, the operator is able to deploy the auxiliary propulsion devices 20, 22 in order to operate in the joysticking mode. As long as the water level W is deep enough, the auxiliary propulsion devices 20, 22 will not hit the bottom B of the waterbed. However, as shown in FIG. 6, if the water level W is shallow, and the operator deploys the auxiliary propulsion devices 20, 22, the auxiliary propulsion devices 20, 22 may hit the bottom B of the waterbed, thus damaging the auxiliary propulsion devices 20, 22. Furthermore, the deployed depth of the auxiliary propulsion devices 20, 22 described with respect to FIG. 3 makes them susceptible to damage because the auxiliary propulsion devices 20, 22 would run aground before the pontoons 36, 38, 40.

Through research and development, the present inventor has recognized that most experienced marine vessel operators are accustomed to trimming a primary propulsion device 14 on a marine vessel 10 up when they enter shallow water. For example, the primary propulsion device 14 in FIG. 6 is shown as being rotated by the trim actuator on the mounting bracket 16 about a horizontal tilt/trim axis (see 44, FIG. 1) to a position that is at a greater angle with respect to vertical than the angle of the primary propulsion device 14 with respect to vertical in FIGS. 4 and 5. Thus, the present inventor discovered that linking the position of the auxiliary propulsion devices 20, 22 to that of the primary propulsion device 14 could prevent damage to the auxiliary propulsion devices 20, 22 when the marine vessel 10 enters shallow water. Thus, operators who are not as familiar with newer retractable-thruster-equipped vessels can enjoy the benefits of joysticking mode without the risk that they will run their thrusters aground, which could potentially cause damage.

Figure 7:
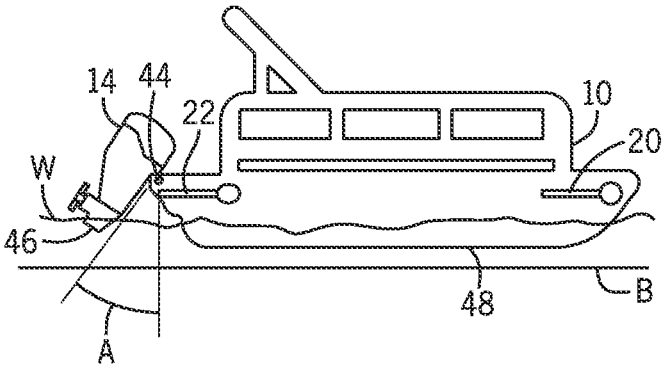
FIG. 7 is a schematic showing the marine vessel with the primary propulsion device and the auxiliary propulsion device operating in shallow water with the auxiliary propulsion device retracted.

Thus, as shown in FIG. 7, the present inventor developed a method for a marine vessel 10 that is carried out by a vessel control system 12 and comprises retracting or maintaining a retracted position of an auxiliary propulsion device 20, 22 on a marine vessel 10 in response to a primary propulsion device 14 on the marine vessel 10 being rotated about a horizontal tilt/trim axis 44 above a predetermined threshold and the auxiliary propulsion device 20, 22 being deployed or commanded to deploy, respectively. In other words, the vessel control system 12 will retract the auxiliary propulsion devices 20, 22 in response to the primary propulsion device 14 on the marine vessel 10 being rotated about the horizontal tilt/trim axis 44 above the predetermined threshold and the auxiliary propulsion devices 20, 22 being in a deployed state. The vessel control system 12 will maintain the retracted position of the auxiliary propulsion devices 20, 22 in response to the primary propulsion device 14 being rotated about the horizontal tilt/trim axis 44 above the predetermined threshold and the auxiliary propulsion devices 20, 22 being commanded to deploy from the retracted state. In this way, the auxiliary propulsion devices 20, 22 will be placed or maintained in the retracted position, as shown, when the primary propulsion device 14 is tilted or trimmed above the predetermined threshold.

In FIG. 7, the predetermined threshold is the angle A from vertical, but the predetermined threshold could be other than that shown herein and/or could be measured in a different manner. In one example, as shown herein, the predetermined threshold A is a rotational position about the tilt/trim axis 44 at which a skeg 46 on the primary propulsion device 14 is level with a keel 48 of the marine vessel 10. In another example, the predetermined threshold is a rotational position about the tilt/trim axis 44 commonly referred to as the "trailering" position, in which the primary propulsion device 14 is rotated to its maximum height for trailering of the marine vessel 10. In yet another example, the predetermined threshold is a rotational position about the tilt/trim axis 44 at which the trim actuator on the mounting bracket 16 can no longer rotate the primary propulsion device 14 up, and the tilt actuator (if provided) takes over to accomplish further upward rotation. Note that although the predetermined threshold has been described herein as an angle or a rotational position, the position may be expressed as a percentage, such as a percentage of full trim or full tilt capabilities of the trim and/or tilt actuator(s). The threshold may be defined with respect to vertical, as shown in FIG. 7, or the threshold may be defined with respect to a fully-down trim position, which may be a position in which the lower unit of the primary propulsion device 14 is tucked under. Other ways to define the threshold, which may be stored in the memory of the controller 24 by a manufacturer, installer, or operator, could be used within the scope of the present disclosure.

Figure 8:
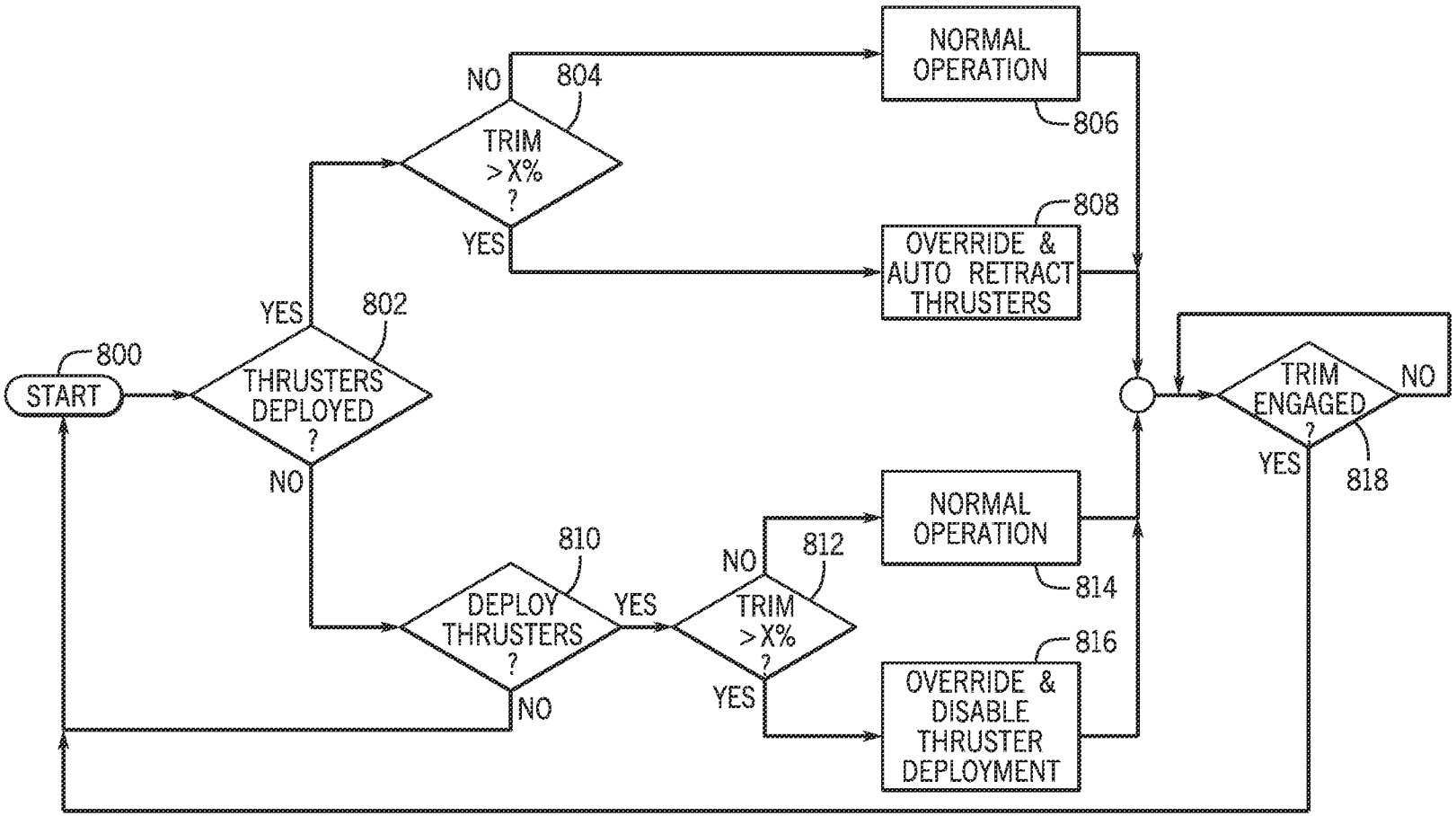
FIG. 8 is a diagram showing exemplary logic a controller of a vessel control system could use to determine whether to retract or deploy an auxiliary propulsion device.

FIG. 8 illustrates logic that that controller 24 may use to carry out the methods of the present disclosure. The logic begins at START at 800. The vessel control system 12 determines if the thrusters are deployed at 802. The vessel control system 12 may make this determination based on readings from sensors (such as Hall effect sensors or potentiometers, depending on the type of actuator 20*a*, 22*a*) located on or near each of the auxiliary propulsion devices 20, 22, or may make the determination based on the controller 24 retrieving the last command to the actuators 20*a*, 22*a*. For example, if the controller 24 determines that it last commanded the actuators 20*a*, 22*a* to deploy the auxiliary propulsion devices, the controller 24 may determine that the auxiliary propulsion devices 20, 22 are still deployed. If the thrusters are deployed (YES at 802), the vessel control system 12 then determines if the primary propulsion device's trim is greater than a predetermined threshold (here, x %), as shown at 804. The vessel control system 12 can make this determination based on a reading from a trim sensor 50 (FIG. 1) associated with the primary propulsion device 14, such as a Hall effect sensor sensing the extension of one portion of the trim actuator with respect to another portion, after which the controller 24 can compare the sensed value to the predetermined threshold stored in its memory. If the trim is not greater than the predetermined threshold, the vessel control system 12 operates normally as shown at 806, and all components remain as-is. If, on the other hand, the trim is greater than the predetermined threshold (YES at 804), the vessel control system 12 automatically retracts the auxiliary propulsion devices 20, 22, as shown at 808.

Returning to 802, if the thrusters are not yet deployed, the vessel control system 12 next determines if a command is input to deploy the thrusters, as shown at 810. For example, the controller 24 may receive the command to deploy the auxiliary propulsion devices 20, 21 from a user input device. In one example, the user input device is the button 32*a* on the joystick 32. In another example, the user input device may be a soft key on a touchscreen or a tactile button provided elsewhere at the control console 26. In still other examples, the user input device is a handheld remote control device, such as a dedicated remote control or a smart device in communication with the controller 24. In still other examples, no extra step is required to deploy the thrusters, and the moment that the joysticking mode is enabled, the controller 24 commands the actuators 20*a*, 22*a* to deploy the auxiliary propulsion devices 20, 22.

If the thrusters are not commanded to deploy (NO at 810), the logic returns to START at 800. If the thrusters are commanded to deploy (YES at 810), the logic continues to 812, where the vessel control system 12 determines if the primary propulsion device's trim is greater than the predetermined threshold. Again, this is done by the controller 24 comparing a predetermined value in its memory to a value sensed by the trim sensor 50. If NO at 812, the vessel control system 12 resumes normal operation, as shown at 814. In other words, the vessel control system 12 deploys the auxiliary propulsion devices 20, 22 in response to the command to deploy the auxiliary propulsion devices 20, 22 if the primary propulsion device 14 is rotated below the predetermined threshold (e.g., x %).

However, if YES at 812, the vessel control system 12 overrides the operator's command to deploy the thrusters and prohibits the auxiliary propulsion devices 20, 22 from being deployed as shown at 816. Because the vessel control system 12 is overriding an operator command, the vessel control system 12 may also generate an alert in response to the command to deploy the auxiliary propulsion devices 20, 22 at 810 if the primary propulsion device 14 is determined to be rotated above the predetermined threshold at 812. For example, the joystick 32 may have lights that flash a different color or may have a screen that generates a written message that the water is too shallow for the thrusters to be deployed. Additionally or alternatively, the alert could be an audible alert via a speaker or a haptic alert (e.g., vibration) via the handle 32*b* of the joystick 32.

Whether at 806, 808, 814, or 816, the controller 24 next determines if the trim system for the primary propulsion device 14 has been engaged, as shown at 818. For example, the vessel control system 12 may determine that the operator has input a "trim up" command or a "trim down" command at the control console 26. If the trim system is not engaged, the logic waits until the trim system is engaged. Once the trim system is engaged (YES at 818), the logic returns to START at 800, and the vessel control system 12 determines if the change in trim position of the primary propulsion device 14 means that the auxiliary propulsion devices 20, 22 need to be retracted (if deployed) or prevented from deploying (if commanded to deploy). Thus, the vessel control system 12 determines if the auxiliary propulsion devices 20, 22 are deployed in response to receiving a command to change a rotational position of the primary propulsion device 14 about the tilt/trim axis 44.

Figure 9:
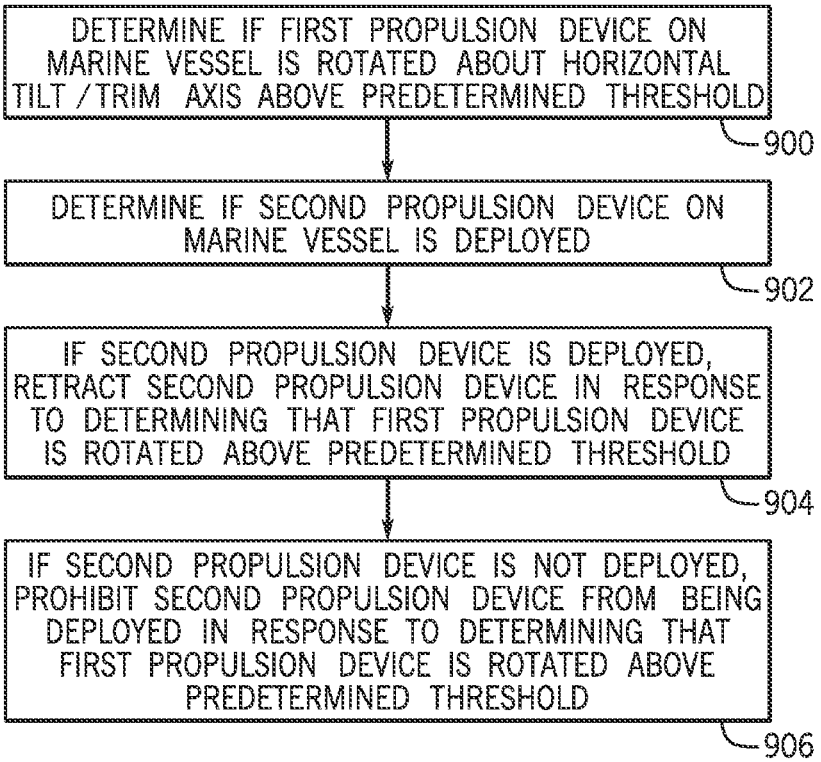
FIG. 9 depicts a method according to the present disclosure.

Thus, referring to FIG. 9, a method for a marine vessel 10 is disclosed. The method is carried out by a vessel control system 12 and comprises determining if a first propulsion device (e.g., primary propulsion device 14) on the marine vessel 10 is rotated about a horizontal tilt/trim axis 44 above a predetermined threshold, as shown at 900. The method also comprises determining if a second propulsion device (e.g., auxiliary propulsion devices 20 and/or 22) on the marine vessel 10 is deployed, as shown at 902. Generally, the two auxiliary propulsion devices 20 and 22 will be deployed or retracted together, so determining if one of the two is deployed or retracted will tell the position of the other. If the second propulsion devices 20 and/or 22 is/are deployed, the method includes retracting the second propulsion devices 20, 22 in response to determining that the first propulsion device 14 is rotated above the predetermined threshold, as shown at 904. If the second propulsion devices 20 and/or 22 is/are not deployed, the method includes prohibiting the second propulsion devices 20, 22 from being deployed in response to determining that the first propulsion device 14 is rotated above the predetermined threshold, as shown at 906.

As described herein above with respect to FIGS. 2 and 3, retracting the second propulsion device comprises moving a thrust-producing portion (e.g., thrust unit 20*c*, 22*c*) of the second propulsion device closer to a hull (e.g., deck 34) of the marine vessel 10. Correspondingly, deploying the second propulsion device comprises moving the thrust-producing portion (e.g., thrust unit 20*c*, 22*c*) of the second propulsion device further from the hull. While a trolling-motor-like thruster was described with respect to the present disclosure, other thrusters as described herein could be controlled according to the same method. Non-limiting examples of thrusters that could be used as the auxiliary propulsion devices 20, 22 include those provided by SideShift of Ontario, Canada; Lewmar of Guilford, Conn.; or Max Power of Monza, Italy.

Note that although the first/primary propulsion device 14 was described as being an outboard engine or a stern drive, and the second/auxiliary propulsion devices 20, 22 were described as being as thrusters, other types of propulsion devices could be used according to the type of vessel and the requirements of the conditions in which the vessel is to operate. More generally, the first propulsion device is a primary propulsion device configured to produce power up to a given first threshold, and the second propulsion device is an auxiliary propulsion device configured to produce power up to a given second threshold that is less than the given first threshold. Thus, the first propulsion device is generally larger and used for faster vessel speeds, while the second propulsion device is generally smaller and used for precise maneuvering at slower speeds and/or in close quarters, such as when docking.

Figure 10:
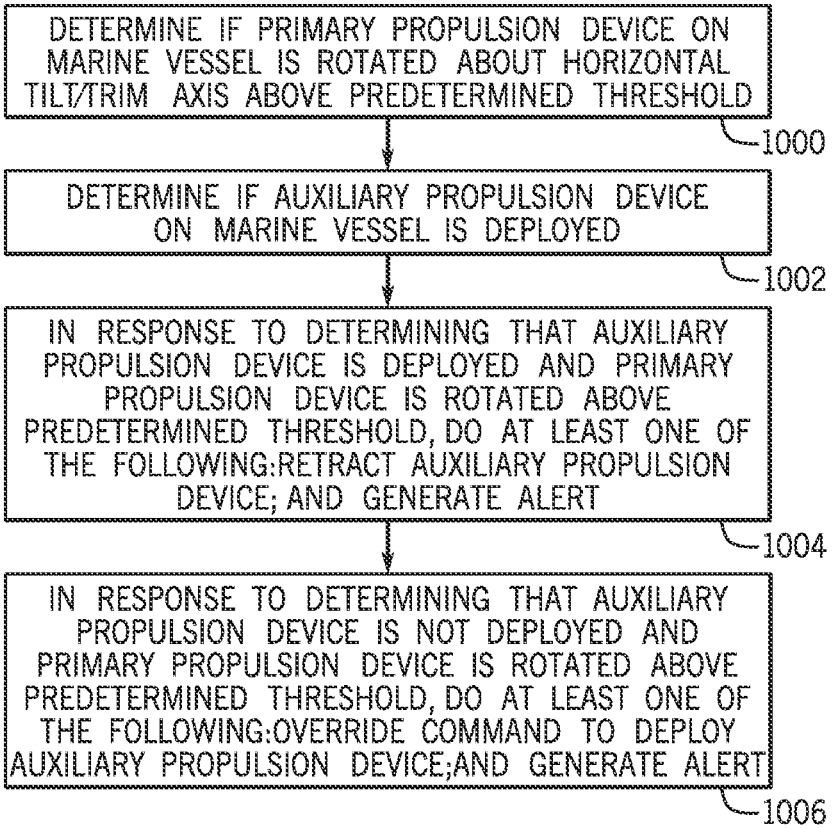
FIG. 10 depicts another method according to the present disclosure.

Furthermore, although the present methods have been described as automatically retracting the auxiliary propulsion devices 20, 22 in response to sensing that they are deployed and the primary propulsion device 14 is rotated up past the threshold, in other examples, the operator is instead merely warned that deploying the thrusters could result in their hitting the bottom of the waterbed, but the thrusters are nonetheless deployed. For example, referring to FIG. 10, another method for a marine vessel 10 is described, the method being carried out by a vessel control system 12. As shown at 1000, the method includes determining if a primary propulsion device 14 on the marine vessel 10 is rotated about a horizontal tilt/trim axis 44 above a predetermined threshold. As shown at 1002, the method includes determining if an auxiliary propulsion device 20 and/or 22 on the marine vessel 10 is deployed. As shown at 1004, in response to determining that the auxiliary propulsion device 20 and/or 22 is deployed and the primary propulsion device 14 is rotated above the predetermined threshold, the method includes doing at least one of the following: retracting the auxiliary propulsion devices 20 and 22 and/or generating an alert. If both actions are taken, then the operator knows that the thrusters have been automatically retracted and the joysticking mode will not be available, as the operator might otherwise be expecting. If only an alert is generated, but the thrusters are not automatically retracted, the operator will at least know that it is possible the thrusters could hit the bottom of the waterbed, and the operator can visually inspect the surroundings of the marine vessel 10 to determine if this is likely. The operator can then choose to override the vessel control system 12, such as by pressing the button 32*a* on the joystick 32 according to a predetermined pattern, or by holding the button 32*a* for a given period of time, in order to dismiss the alert and continue operating in joysticking mode with the primary propulsion device 14 trimmed up above the threshold.

As shown at 1006, in response to determining that the auxiliary propulsion device 20 and/or 22 is not deployed and the primary propulsion device 14 is rotated above the predetermined threshold, the method includes doing at least one of the following: overriding a command to deploy the auxiliary propulsion device 20 and/or 22 and/or generating the alert. According to the first option, as noted herein above, the vessel control system 12 will not act on any command to deploy the auxiliary propulsion devices 20, 22 as long as the primary propulsion device 14 is rotated above the predetermined threshold. The alert may also be provided in order to inform the operator that the joysticking mode will not be available because the thrusters are not deployed. The vessel control system 12 may alternatively carry out the second option alone, such that the vessel control system 12 deploys the auxiliary propulsion devices 20, 22 in response to a command to do so, while also generating an alert, letting the operator know that the auxiliary propulsion devices 20, 22 could be damaged by such deployment. In yet another example, the alert could be followed by a wait time, during which the operator can determine if the operator wants to deploy the auxiliary propulsion devices 20, 22 in spite of the alert. For example, if the wait time passes without the operator taking any action to confirm that the auxiliary propulsion devices 20, 22 should be deployed, the auxiliary propulsion devices 20, 22 may be maintained in the retracted state. If desired, the operator can confirm that the auxiliary propulsion devices 20, 22 are to be deployed by selecting the button 32*a* again or by holding the button 32*a* down for a given period of time.

In another example, the controller 24 is configured to generate an alert when the primary propulsion device 14 is trimmed up to a first predetermined threshold, which is less than a second predetermined threshold at which the vessel control system 12 will automatically retract the auxiliary propulsion devices 20, 22 (if deployed) or prohibit their deployment (if retracted). The first predetermined threshold could be, by way of non-limiting example, 90% of the second predetermined threshold.

In still other examples, if the auxiliary propulsion devices 20, 22 are automatically retracted or are prohibited from being deployed, the controller 24 may be configured to operate the primary propulsion device 14 to carry out limited operating in the joysticking mode in response to the button 32*a* being pressed and the joystick manipulated.

In still other examples, the marine vessel 10 and/or propulsion devices 14, 20, 22 may be equipped with SONAR that can determine the depth of the water in which the marine vessel 10 is operating. The controller 24 can be programmed with the deployed depth of the auxiliary propulsion devices 20, 22, and can compare the water depth to the depth of the auxiliary propulsion devices 20, 22 to determine if they need to be retracted or prohibited from deploying. Similarly, if GPS data is available on the marine vessel 10, as well as bathymetric data, the GPS position of the marine vessel 10 can be compared to known water depths to determine if it is likely the auxiliary propulsion devices 20, 22 will strike the waterbed. The controller 24 may make the comparison to SONAR or GPS-based depth data in response to the primary propulsion device 14 being trimmed above the predetermined threshold and the auxiliary propulsion devices 20, 22 being deployed or commanded to deploy, or the controller 24 may make the comparison only in response to the auxiliary propulsion devices 20, 22 being commanded to deploy.

Although the present examples were described with respect to a pontoon boat, the present systems and methods can also be used on catamarans, boats with V-shaped hulls, or boats with any other type of hull capable of supporting a primary propulsion device and auxiliary propulsion device(s).

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A method for a marine vessel, the method being carried out by a vessel control system and comprising:

determining if a first propulsion device on the marine vessel is rotated about a horizontal tilt/trim axis above a predetermined threshold;

determining if a second propulsion device on the marine vessel is deployed;

if the second propulsion device is deployed, retracting the second propulsion device in response to determining that the first propulsion device is rotated above the predetermined threshold; and if the second propulsion device is not deployed, prohibiting the second propulsion device from being deployed in response to determining that the first propulsion device is rotated above the predetermined threshold.

2. The method of claim 1, wherein the first propulsion device is a primary propulsion device configured to produce power up to a given first threshold, and the second propulsion device is an auxiliary propulsion device configured to produce power up to a given second threshold that is less than the given first threshold.

3. The method of claim 1, wherein the first propulsion device is an outboard motor or a stern drive and the second propulsion device is a thruster.

4. The method of claim 1, wherein the predetermined threshold is a rotational position about the tilt/trim axis at which a skeg on the first propulsion device is level with a keel of the marine vessel.

5. The method of claim 1, further comprising receiving a command to deploy the second propulsion device from a user input device.

6. The method of claim 5, wherein the user input device is a button on a joystick.

7. The method of claim 5, further comprising deploying the second propulsion device in response to the command to deploy the second propulsion device if the first propulsion device is rotated below the predetermined threshold.

8. The method of claim 5, further comprising generating an alert in response to the command to deploy the second propulsion device if the first propulsion device is rotated above the predetermined threshold.

9. The method of claim 1, further comprising determining if the second propulsion device is deployed in response to receiving a command to change a rotational position of the first propulsion device about the tilt/trim axis.

10. The method of claim 1, wherein retracting the second propulsion device comprises moving a thrust-producing portion of the second propulsion device closer to a hull of the marine vessel, and deploying the second propulsion device comprises moving the thrust-producing portion of the second propulsion device further from the hull.

11. A method for a marine vessel, the method being carried out by a vessel control system and comprising retracting or maintaining a retracted position of an auxiliary propulsion device on the marine vessel in response to a primary propulsion device on the marine vessel being rotated about a horizontal tilt/trim axis above a predetermined threshold and the auxiliary propulsion device being deployed or commanded to deploy, respectively.

12. The method of claim 11, wherein the primary propulsion device is configured to produce power up to a given first threshold, and the auxiliary propulsion device is configured to produce power up to a given second threshold that is less than the given first threshold.

13. The method of claim 11, wherein the primary propulsion device is an outboard motor or a stern drive and the auxiliary propulsion device is a thruster.

14. The method of claim 11, wherein the predetermined threshold is a rotational position about the tilt/trim axis at which a skeg on the primary propulsion device is level with a keel of the marine vessel.

15. The method of claim 11, further comprising receiving a command to deploy the auxiliary propulsion device from a user input device.

16. The method of claim 15, wherein the user input device is a button on a joystick.

17. The method of claim 15, further comprising deploying the auxiliary propulsion device in response to the command to deploy the auxiliary propulsion device if the primary propulsion device is rotated below the predetermined threshold.

18. The method of claim 15, further comprising generating an alert in response to the command to deploy the auxiliary propulsion device if the primary propulsion device is rotated above the predetermined threshold.

19. The method of claim 11, wherein retracting the auxiliary propulsion device comprises moving a thrust-producing portion of the auxiliary propulsion device closer to a hull of the marine vessel, and deploying the auxiliary propulsion device comprises moving the thrust-producing portion of the auxiliary propulsion device further from the hull.

20. A method for a marine vessel, the method being carried out by a vessel control system and comprising:

determining if a primary propulsion device located proximate a stern of the marine vessel is rotated about a horizontal tilt/trim axis above a predetermined threshold;

determining if an auxiliary propulsion device located proximate a bow of the marine vessel is deployed;

in response to determining that the auxiliary propulsion device is deployed and the primary propulsion device is rotated above the predetermined threshold, doing at least one of the following:

retracting the auxiliary propulsion device; and generating an alert; and in response to determining that the auxiliary propulsion device is not deployed and the primary propulsion device is rotated above the predetermined threshold, doing at least one of the following:

overriding a command to deploy the auxiliary propulsion device; and generating the alert.

* * * * *